US009868142B2

(12) United States Patent
Chen et al.

(10) Patent No.: US 9,868,142 B2
(45) Date of Patent: Jan. 16, 2018

(54) COOLING DEVICE WITH BREADTH-DEPENDENT COOLING ACTION

(71) Applicant: PRIMETALS TECHNOLOGIES AUSTRIA GMBH, Linz (AT)

(72) Inventors: Jian Chen, St. Marien (AT); Sieglinder Ehgartner, Linz (AT); Reinhard Karl, Klosterneuburg (AT); Erich Opitz, Moenchhof (AT); Florian Poeschl, Linz (AT); Alois Seilinger, Linz (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 181 days.

(21) Appl. No.: 14/784,812

(22) PCT Filed: Apr. 4, 2014

(86) PCT No.: PCT/EP2014/056771
§ 371 (c)(1),
(2) Date: Oct. 15, 2015

(87) PCT Pub. No.: WO2014/170139
PCT Pub. Date: Oct. 23, 2014

(65) Prior Publication Data

US 2016/0052033 A1 Feb. 25, 2016

(30) Foreign Application Priority Data

Apr. 15, 2013 (EP) ..... 13163666

(51) Int. Cl.
*B21B 43/00* (2006.01)
*B21B 45/02* (2006.01)

(52) U.S. Cl.
CPC ..... *B21B 43/00* (2013.01); *B21B 45/0218* (2013.01); *B21B 45/0233* (2013.01)

(58) Field of Classification Search
CPC ..... B21B 37/74; B21B 45/02; B21B 45/0203; B21B 45/0215; B21B 45/0218; B21B 45/0233; B21B 43/00
See application file for complete search history.

(56) References Cited

U.S. PATENT DOCUMENTS 4,591,133 A * 5/1986 Umeno ..... B21B 45/0233 266/114
5,518,222 A * 5/1996 Buxton ..... B21B 45/0233 266/114

(Continued)

FOREIGN PATENT DOCUMENTS

CN 102189131 A 9/2011
CN 201969738 U 9/2011

(Continued)

OTHER PUBLICATIONS

Notice of Allowance dated Feb. 6, 2017 in corresponding Japanese Patent Application No. 2016-508077 (total 3 pages).

(Continued)

*Primary Examiner* — Edward Tolan
(74) *Attorney, Agent, or Firm* — Ostrolenk Faber LLP

(57) ABSTRACT

A flat rolled article (2) passes through a cooling device (1) in a transportation direction (x) at the level of a passline (3). Spray bars (5, 6) extend transversely with respect to the transportation direction (x). The spray bars (5, 6) have, as viewed perpendicular to the transportation direction (x), in each case two outer regions (7, 8) and a central region (9) in between. A liquid cooling medium (13) can be fed into the regions (7, 8, 9) via respective dedicated, individually controllable valve devices (10, 11, 12). Flow rate profiles, pertaining to each region may be set, wherein each region (7, 8, 9) is triangular in shape. The central triangle and the two outer triangles combine to form a rectangle.

14 Claims, 4 Drawing Sheets

(56) References Cited

U.S. PATENT DOCUMENTS

| | | | | |
|---|---|---|---|---|
| 2002/0104597 | A1 | 8/2002 | Frank et al. | |
| 2004/0244886 | A1 * | 12/2004 | Tsuyama | B21B 45/0218 148/661 |
| 2009/0126439 | A1 * | 5/2009 | Ueoka | B21B 45/0218 72/201 |
| 2010/0024505 | A1 * | 2/2010 | Ueoka | B21B 45/0233 72/202 |
| 2010/0219565 | A1 * | 9/2010 | Yamamoto | B21B 45/0218 266/44 |
| 2011/0162427 | A1 * | 7/2011 | Nakata | B21B 45/0233 72/201 |

FOREIGN PATENT DOCUMENTS

| | | | | |
|---|---|---|---|---|
| DE | 19854675 | A1 * | 6/2000 | B21B 45/02 |
| DE | 19934557 | A1 * | 2/2001 | B21B 45/02 |
| JP | S5196005 | U | 8/1976 | |
| JP | S 51-147449 | | 12/1976 | |
| JP | H03111557 | U | 11/1991 | |
| JP | 2610019 | B2 * | 2/1997 | B21B 37/74 |
| JP | 2001321823 | A | 11/2001 | |
| JP | 2008194712 | A | 8/2008 | |
| JP | 2011167754 | A | 9/2011 | |

OTHER PUBLICATIONS

International Search Report dated Jul. 22, 2014 issued in corresponding International patent application No. PCT/EP2014/056771.
Written Oinion dated Jul. 22, 2014 issued in corresponding International patent application No. PCT/EP2014/056771.
European Search Report dated Sep. 11, 2013 issued in corresponding European patent application No. 13 16 3666.
Chinese Office Action, dated May 23, 2016, issued in corresponding Chinese Patent Application No. 201480021293.X. English Translation. Total 11 pages.

* cited by examiner

COOLING DEVICE WITH BREADTH-DEPENDENT COOLING ACTION

CROSS-REFERENCE TO RELATED APPLICATIONS

The present application is a 35 U.S.C. §§ 371 national phase conversion of PCT/EP2014/056771, filed Apr. 4, 2014, which claims priority of European Application No. 13163666.4, filed Apr. 15, 2013, the contents of which are incorporated by reference herein. The PCT International Application was published in the German language.

The present invention relates to a cooling device for a flat rolled product. The flat rolled product passes through the cooling device in a transportation direction at the level of a passline. The cooling device includes a cooling bed which has a plurality of spray bars. Each spray bar extends transversely with respect to the transportation direction, and the spray bars are arranged in succession in the transportation direction.

Viewed transversely to the transportation direction, each spray bar has two outer sections and a central section between the two outer sections. The flat rolled product passing through the cooling device is impinged upon with a central flow rate profile of a liquid cooling medium by outlet orifices arranged in the central section. When viewed transversely to the transportation direction, the central flow rate profile is at a maximum in the center and decreases toward both of its lateral edges.

The flat rolled product is impinged upon with a respective outer flow rate profile of the liquid cooling medium outlet orifices arranged in the laterally outer sections. When viewed transversely to the transportation direction, the respective outer flow rate profile is at a maximum at the respective outer edges of the outer sections and decreases toward the center. Thus, the outer flow rate profiles of the successive array of spray bars in each case define an outer triangle in which one side runs parallel to and one side runs transversely to the transportation direction.

The present invention further relates to a rolling train for rolling flat rolled product. The rolling train has at least one roughing stand and a number of finishing stands located downstream of the roughing stand. A cooling device of the type described is positioned immediately upstream of the roughing stand or downstream between the roughing stand and the finishing stand located immediately downstream of the roughing stand.

An example of a cooling device of the above type is known by the name Mulpic. A liquid cooling medium is injected into the central section on the one side and into the two outer sections on the other side via a respective dedicated, individually controllable valve device. The central flow rate profile defines a symmetric trapezoid. Its parallel sides run transversely to the transportation direction. The trapezoid and the two outer triangles laterally outside the trapezoid combine to form a rectangle. The valve devices are actuated such that the volume of cooling medium applied to the flat rolled product via the two outer sections and the volume of cooling medium applied to the flat rolled product via the central section are coordinated such that a temperature of edge sections of the flat rolled product is adjusted to match a temperature of a central section of the flat rolled product.

In some cases, the flat rolled product may have a temperature ridge, when viewed over the width of the flat rolled product, i.e. the flat rolled product is hotter on one side than on the other side. In such a case it would be of advantage to be able to cool the one side of the flat rolled product more intensively than the other side. The known device described above is unsuitable for this purpose.

SUMMARY OF THE INVENTION

The object of the present invention is to create possibilities to enable elimination of a thermal ridge of the above type.

According to the invention, a cooling device generally of the type described above is embodied such that a liquid cooling medium is injected into the sections via a respective dedicated, individually controllable valve device. The central flow rate profile defines a central triangle in which one side runs transversely to the transportation direction and the two other sides are of equal length. The central triangle and the two outer triangles combine to form a rectangle.

Within the scope of the maximum possible cooling medium volumes, this makes it possible to counteract a thermal ridge over the entire width of the flat rolled product. In contrast to the prior art, appropriate individual control of the two outer sections continues to remain possible, to cool the two edge regions of the flat rolled product to a lesser degree than to cool the central section of the flat rolled product. It is further possible, while cooling the two edges less intensively than the central section of the flat rolled product, to cool the two edges to different degrees of intensity.

In a simple embodiment of the cooling device, the valve devices are switched in a binary manner, i.e. they are either fully open or fully closed. In the simplest case there is no other possibility of influencing the volume of liquid discharged over the respective section. Preferably, however, the volume of liquid cooling medium injected into the sections can be set by adjustment of an operating pressure generated by a respective pump and/or by adjustment of a delivery volume effected by means of the respective pump. Furthermore, the valve devices may be embodied as servo valves or as proportional valves. In this case, the liquid cooling medium can be at a constant pressure upstream of the valve devices, for example due to pumps located upstream generating a constant pressure or because the liquid cooling medium is supplied from an overhead reservoir.

In a minimum configuration of the inventive cooling device, only a single spray bar is present. In this case, the spray bar is generally arranged above the passline. In individual cases, the spray bar can alternatively be arranged below the passline. Often, however, more than one spray bar is present. The number of spray bars consequently amounts to at least two. In this case at least one spray bar is preferably arranged above, and at least another below, the passline. This enables the flat rolled product to be cooled to an equal extent from both opposite sides.

Regardless of the number of spray bars, at least one of the spray bars may be arranged on a holding frame having a fixed position with respect to the passline. In this case, the spray bar may be assigned an adjusting device for setting a distance of the spray bar from the passline. This embodiment may be used in particular to maximize the distance of the spray bar from the passline during maintenance work on the spray bar and/or for example on a roller table defining the passline. An adjustment range for this distance can be varied as required.

Preferably, it amounts to at least 20 cm, for example at least 30 cm, in particular at least 50 cm. Greater values are also possible.

By means of the adjusting device, it is also possible to pivot a spray bar that is arranged on a holding frame fixed in position with respect to the passline through a pivoting angle about an axis of rotation.

The two measures of adjustment of the distance and the pivoting movement, can also be combined for the same spray bar. In this case, the corresponding spray bar is arranged on an intermediate frame which in turn is arranged on a holding frame which is fixed in position with respect to the passline. A respective adjusting device is assigned to the spray bar and to the intermediate frame. It is possible to set a distance of the spray bar from the intermediate frame by the adjusting device for the spray bar. In this case, the intermediate frame may be pivoted through the pivoting angle about its axis of rotation by the adjusting device for the intermediate frame.

Alternatively, the reverse approach can be adopted. In this case, the spray bar can be pivoted through the pivoting angle about the axis of rotation by the adjusting device for the spray bar. In this case the distance of the intermediate frame from the holding frame can be set by the adjusting device assigned to the intermediate frame.

If a pivoting movement is possible, the axis of rotation is typically arranged at the edge of said spray bar, when viewed transversely to the transportation direction, and runs parallel to the transportation direction. The pivoting angle can be set as required. Preferably, the angle is at least 20°. For example, the pivoting angle is at least 30°, at least 45° or at least 60°. Greater pivoting angles, up to 90° and beyond, are also possible.

The object is further achieved by a rolling train for rolling flat rolled product. According to the invention, a rolling train of the type cited in the introduction is embodied, and the cooling device is embodied according to the invention.

The above-described characteristics, features and advantages of this invention, as well as the manner in which these are realized, will become clearer and more readily understandable in connection with the following description of the exemplary embodiments, which are explained in more detail in conjunction with the accompanying schematic drawings

DESCRIPTION OF THE EMBODIMENT

Figure 1:
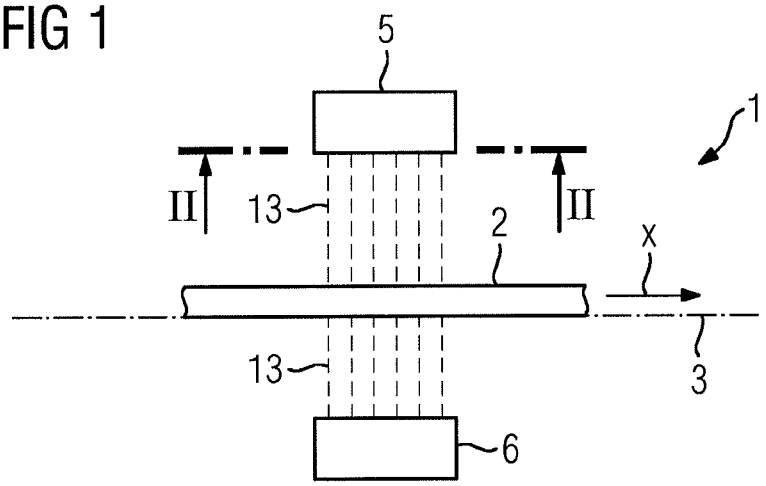
FIG. 1 shows a cooling device from the side.

According to FIG. 1, a cooling device 1 for a flat rolled product 2, is passed through by the rolled product 2 at the level of a passline 3 in a transportation direction x. The passline 3 can be defined for example by the arrangement of a device located upstream and/or a device located downstream. The upstream device can be embodied for example as a caster, as a furnace or as a rolling stand. The downstream device can be embodied for example as a rolling stand, as a roller table or as a cooling bed. Other embodiments of that device are also possible.

The cooling device 1 has a number of spray bars 5, 6. It is also possible for only a single spray bar 5, 6 to be present. Generally, however, a plurality of spray bars 5, 6 are present, that is, at least two spray bars 5, 6. According to FIG. 1, preferably at least one of the spray bars 5, 6 is arranged above and at least one other below the passline 3. The spray bar 5 above the passline 3 is the upper spray bar 5, and the spray bar 6 below the passline 3 is the lower spray bar 6.

Possible embodiments of the upper spray bar 5 are explained below in conjunction with FIGS. 2 to 9. The same embodiments can be realized alternatively or in addition, for the lower spray bar 6.

Figure 2:
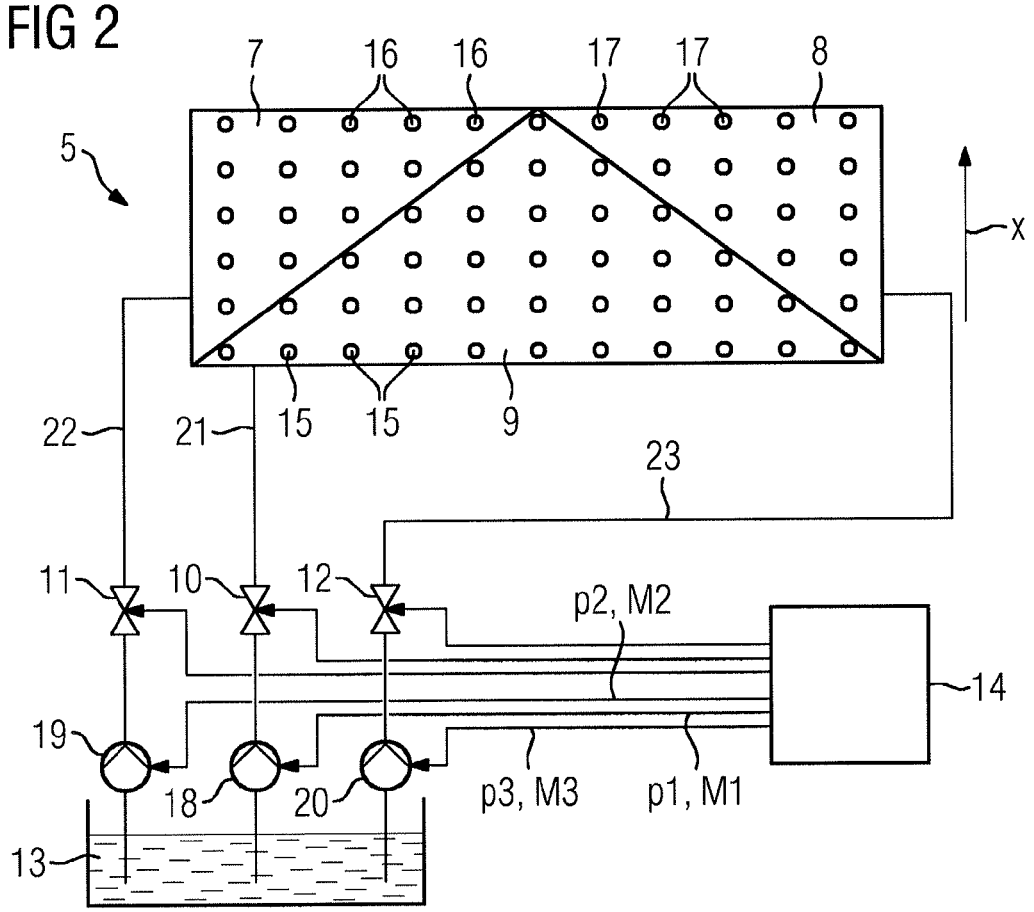
FIG. 2 shows a cooling device viewed from a passline.

In FIG. 2, the upper spray bar 5 extends transversely to the transportation direction x. Viewed transversely to direction x, the spray bar 5 has two outer sections 7, 8 and a central section 9. Viewed transversely to direction x, the central section 9 is between the two outer sections 7, 8. A liquid cooling medium 13 can be injected into each of the two outer sections 7, 8 and the central section 9 via a respective dedicated valve device 10, 11, 12. The valve devices 10, 11, 12 may be actuated individually by a control device 14. Each of the valve devices 10, 11, 12 is therefore controllable independently of the two other valve devices.

The flat rolled product 2 can be impinged upon with a flow rate profile V1 of the liquid cooling medium 13 by outlet orifices 15 in the central section 9. In an analogous manner, the flat rolled product 2 can be impinged upon with a respective flow rate profile V2, V3 of the liquid cooling medium 13 by outlet orifices 16, 17 in the two outer sections 7, 8. The flow rate profiles V1, V2, V3 are referred to as central flow rate profile V1, left outer flow rate profile V2 and right outer flow rate profile V3. The term "flow rate profile" herein, relates to a location-based profile, not a time-based profile. This will become more apparent with reference to the following explanations in relation to FIG. 3 and FIGS. 4 to 7.

When the valve device 10 assigned to the central section 9 is fully opened, the central flow rate profile V1 is applied to the flat rolled product 2. According to FIG. 3, the central flow rate profile V1 is at a maximum in the center, when viewed transversely to the transportation direction x. The central flow rate profile V1 decreases linearly toward both lateral edges of the spray bar. The central flow rate profile V1 accordingly defines a central triangle. One side of the central triangle runs transversely to the transportation direction x. The two other sides of the central triangle are of equal length. The central triangle is an isosceles triangle.

When the valve device 11 that is assigned to the left outer section 7 is fully opened, the left outer flow rate profile V2 is applied to the flat rolled product 2. According to FIG. 3, the left outer flow rate profile V2 is at a maximum at the left-hand edge, when viewed transversely to the transportation direction x. The left outer flow rate profile V2 decreases toward the center. The decrease proceeds linearly toward the center. The left outer flow rate profile V2 accordingly defines a left outer triangle. One side of the left outer triangle runs parallel to the transportation direction x. Another side of the left outer triangle runs transversely to the transportation direction x. The left outer triangle is therefore a right-angled triangle.

When the valve device 12 assigned to the right outer section 8 is fully opened, the right outer flow rate profile V3 is applied to the flat rolled product 2. According to FIG. 3, the right outer flow rate profile V3 is at a maximum at the right-hand edge, when viewed transversely to the transportation direction x. The right outer flow rate profile V3 decreases toward the center. The decrease proceeds linearly toward the center. The right outer flow rate profile V3 accordingly defines a right outer triangle. One side of the right outer triangle runs parallel to the transportation direction x. Another side of the right outer triangle runs transversely to the transportation direction x. The right outer triangle is therefore likewise a right-angled triangle.

It is apparent that the central triangle and the two outer triangles combine to form a rectangle. A resulting localized flow rate profile V, in other words the sum of the flow rate profiles V1, V2 and V3, is indicated by a dashed line in the drawing in FIG. 5.

In order to realize the respective triangular flow rate profile V1, V2, V3, the outlet orifices 15, 16, 17 can be arranged for example according to the illustration in FIG. 2 in a number of rows which succeed one another, when viewed in the transportation direction x. Alternatively or in addition, the outlet orifices 15, 16, 17 can be appropriately configured such that the volume of cooling medium 13 exiting the respective outlet orifices 15, 16, 17 varies.

Figure 3:
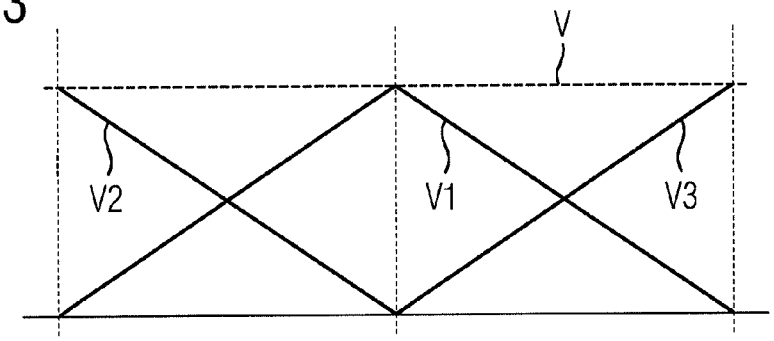
FIG. 3 shows maximum cooling medium flow rate profiles.

The flow rate profiles V1, V2, V3 shown in FIG. 3 represent the maximum possible flow rate profiles. Said flow rate profiles V1, V2, V3 are therefore applied to the flat rolled product 2 when the valve devices 10, 11, 12 assigned to the sections 7, 8, 9 are fully open and delivery volumes M1, M2, M3 which are injected into the sections 7, 8, 9 are at a maximum. The delivery volumes M1, M2, M3 can be constant. Preferably, however, they are individually continuously adjustable. As a result, depending on the settings of delivery volumes M1, M2, M3 a desired resulting localized flow rate profile V can be set within the adjustment limits. Several possible resulting localized flow rate profiles V are explained in more detail below in conjunction with FIGS. 4 to 7.

Figure 4:
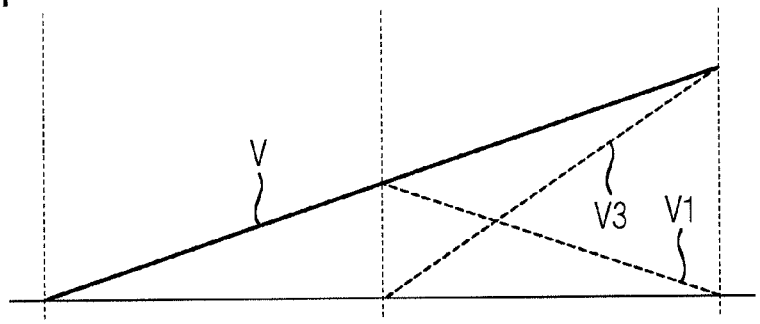
FIGS. 4 to 7 show by way of example possible resulting cooling medium flow rate profiles.

According to FIG. 4, the valve device 11 assigned to the left outer section 7 remains closed. The associated delivery volume M2 is therefore 0. The right outer section 8 is supplied with the maximum possible delivery volume M3 (or a slightly smaller volume) via the assigned valve device 12. A central delivery volume M1 is supplied to the central section 9 via the assigned valve device 10. The corresponding flow rate profiles V1, V3 are indicated by dashed lines in the drawing in FIG. 4. The overall resulting flow rate profile V is indicated by a solid line. It is evident that a thermal ridge in the flat rolled product 2 can be corrected by means of the resulting flow rate profile V according to FIG. 4.

Figure 5:
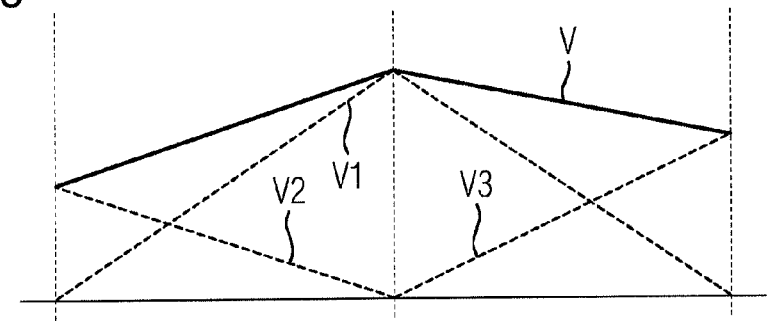

According to FIG. 5, the left outer section 7 is supplied with a central delivery volume M2 via the assigned valve device 11. A relatively high, though not the maximum delivery volume M3 is supplied to the right outer section 8 via the assigned valve device 12. The central section 9 is supplied with the maximum possible delivery volume M1 (or a slightly smaller volume) via the assigned valve device 10. The corresponding flow rate profiles V1, V2, V3 are indicated by dashed lines in the drawing in FIG. 5. The overall resulting flow rate profile V is indicated by a solid line. It is evident that an enhanced cooling of the central section of the flat rolled product 2 can be effected with the resulting flow rate profile V according to FIG. 5, though the two edges are cooled to different degrees of intensity.

Figure 6:
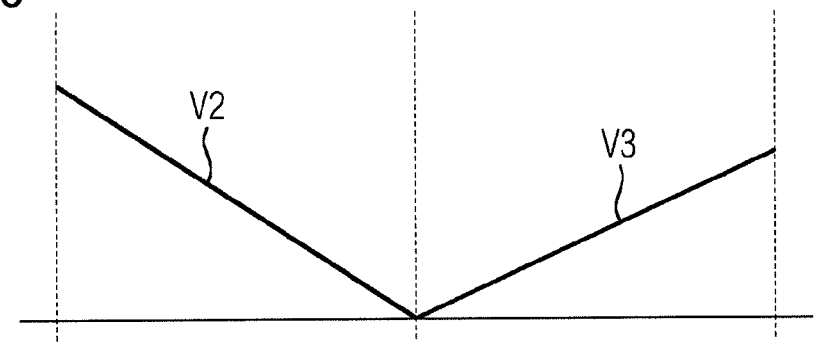

According to FIG. 6, a relatively high delivery volume M2 is supplied to the left outer section 7 via the assigned valve device 11. A slightly lower delivery volume M3 is supplied to the right outer section 8 via the assigned valve device 12. The valve device 10 assigned to the central section 9 is closed. The corresponding delivery volume M1 is therefore 0. The corresponding flow rate profiles V2, V3 are indicated by solid lines in the drawing in FIG. 5. The overall resulting flow rate profile V corresponds in the left part to the flow rate profile V2, and in the right part to the flow rate profile V3. It is evident that the edges of the flat rolled product 2 can be cooled to different levels of intensity with the resulting flow rate profile V according to FIG. 6.

Figure 7:
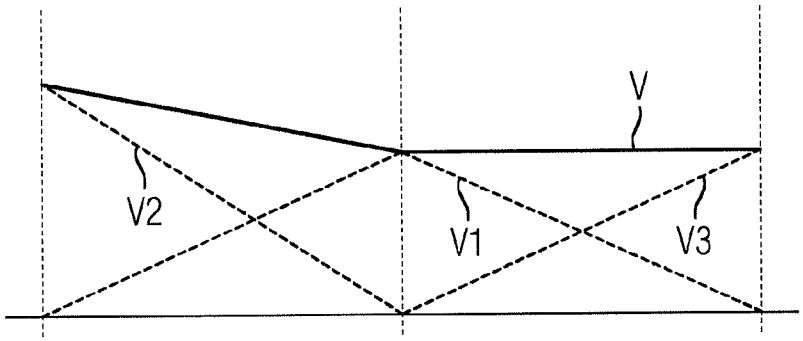

According to FIG. 7, the right outer section 8 and the central section 9 are supplied with delivery volumes M1, M3, which are combined in the right part of the flat rolled product 2 to form a constant flow rate profile V. The left outer section 7 is supplied with a delivery volume M2 which is greater than the delivery volume M3 supplied to the right outer section 8. As a result, the left edge of the flat rolled product 2 is cooled more intensively starting from the center of the flat rolled product 2. The resulting flow rate profile V therefore increases toward the left edge. Alternatively, the delivery volume M2 supplied to the left outer section 7 could be less than the delivery volume M3 supplied to the right outer section 8. In this case the left edge of the flat rolled product 2 would be cooled less intensively starting from the center of the flat rolled product 2, i.e. the resulting flow rate profile would decrease.

The delivery volumes M1, M2, M3 explained hereinabove in conjunction with FIGS. 4 to 7 serve as examples. Other combinations are also possible according to requirements.

In order to be able to adjust the delivery volumes M1, M2, M3, the valve devices 10, 11, 12 may be embodied as servo valves. Preferably, however, the valve devices 10, 11, 12 are switched in a binary manner. Depending on the actuation state, they are therefore either fully open or fully closed. No intermediate settings are assumed. In this case, insofar as the delivery volumes M1, M2, M3 are adjustable, they are set by pumps 18, 19, 20, each located upstream of the respective valve device 10, 11, 12. The delivery volume M1, M2, M3 effected by the respective pump 18, 19, 20 can be set directly. Alternatively or in addition, an operating pressure p1, p2, p3 effected by the respective pump 18, 19, 20 in a respective feed line 21, 22, 23 can be adjusted.

Figure 8:
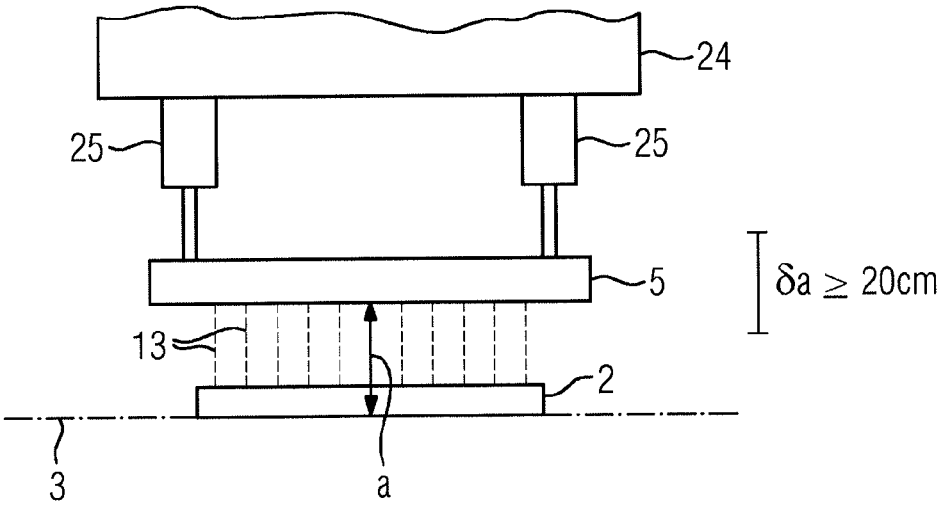
FIGS. 8 and 9 show adjustment options for a spray bar.

In the embodiment according to FIG. 8, the upper spray bar 5 is arranged on a holding frame 24. The position of the holding frame 24 is fixed with respect to the passline 3. An adjusting device 25 is assigned to the upper spray bar 5. The adjusting device 25 can, for example, be embodied as a number of hydraulic cylinder units. For example, two hydraulic cylinder units can be present which are mounted on the left and right on the holding frame 24 and on the upper spray bar 5. A distance a of the upper spray bar 5 from the passline 3 can be set by means of the adjusting device 25. An adjustment range $\delta a$, i.e. the difference between maximum possible distance a and minimum possible distance a, can be chosen as required. The adjustment range $\delta a$ preferably amounts to at least 20 cm. It can also have greater values, for example 30 cm (or more) or 50 cm. Even greater values are also possible.

Figure 9:
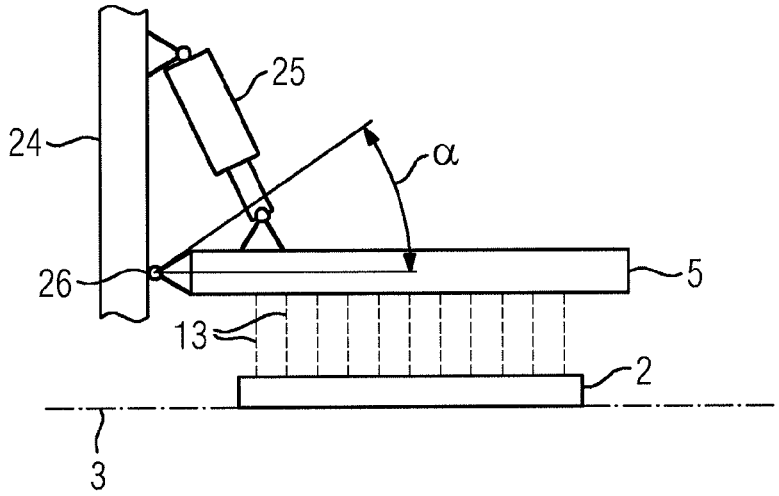

In the embodiment according to FIG. 9, the upper spray bar 5 is likewise arranged on the holding frame 24, the position of which is fixed with respect to the passline 3. An adjusting device 25 is also assigned to the upper spray bar 5 in the embodiment according to FIG. 9. In this case too, the adjusting device 25 can (for example) be embodied as a number of hydraulic cylinder units. The upper spray bar 5 can be pivoted about an axis of rotation 26 by means of the adjusting device 25. According to FIG. 9, the axis of rotation 26 is arranged at the edge of said spray bar 5, when viewed transversely to the transportation direction x. It preferably runs parallel to the transportation direction x.

A pivoting angle $\alpha$, in other words the angle through which the upper spray bar 5 can be pivoted, can be chosen as required. Preferably, the pivoting angle α amounts to at least 20°. For example, the pivoting angle α can amount to at least 30°, at least 45° or at least 60°. Even greater pivoting angles a even up to 90° and beyond, are also possible.

The two adjustment options, that is, the setting of the distance a and the pivoting movement about the axis of rotation 26, can also be combined.

Figure 10:
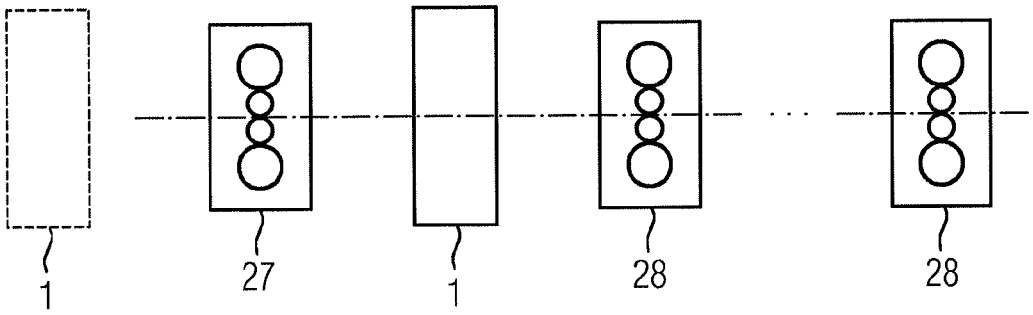
FIG. 10 shows a rolling train.

According to FIG. 10, the inventive cooling device 1 is preferably employed in a rolling train in which the flat rolled product 2 is rolled. According to FIG. 10, the rolling train has at least one roughing stand 27. In addition, the rolling train has a number of finishing stands 28. The finishing stands 28 are located downstream of the roughing stand 27, when viewed in the transportation direction x. The number of finishing stands 28 typically ranges between four and eight, and in most cases is five, six or seven. The cooling device 1 may be located immediately upstream of the roughing stand 27, as indicated by the dashed outline in FIG. 10. Generally, however, the cooling device 1 is located downstream of the roughing stand 27. It is therefore arranged between the roughing stand 27 and that finishing stand 28 which is located immediately downstream of the roughing stand 27. In rare individual cases there can also be two cooling devices 1 present, in which event one of the two cooling devices 1 is positioned immediately upstream of the roughing stand 27, and the other is positioned immediately downstream thereof.

The inventive cooling device 1 can be deployed as part of what is known as a laminar cooling system. Preferably, however, it is utilized within the context of a process known as intensive cooling. In an intensive cooling process, the operating pressures p1, p2, p3 typically amount to at least 0.5 bar. In most cases they even lie above 1.0 bar. For example, they can range between 1.5 bar and 3.0 bar.

The inventive cooling device 1 has many advantages. In particular, flexible cooling of the flat rolled product 2 over its entire width can be realized in a simple manner.

Although the invention has been illustrated and described in greater detail on the basis of the preferred exemplary embodiment, the invention is not limited by the disclosed examples and other variations can be derived herefrom by the person skilled in the art without leaving the scope of protection of the invention.

LIST OF REFERENCE SIGNS

1 Cooling device
2 Flat rolled product
3 Passline
5 Upper spray bar
6 Lower spray bar
7, 8 Outer sections
9 Central section
10, 11, 12 Valve devices
13 Liquid cooling medium
14 Control device
15, 16, 17 Outlet orifices
18, 19, 20 Pumps
21, 22, 23 Feed lines
24 Holding frame
25 Adjusting device
26 Axis of rotation
27 Roughing stand
28 Finishing stands
M1, M2, M3 Delivery volumes
p1, p2, p3 Operating pressures
V, V1, V2, V3 Flow rate profiles
x Transportation direction
α Pivoting angle
δa Adjustment range

The invention claimed is:

1. A cooling device for a flat rolled product, wherein the flat rolled product passes through the cooling device in a transportation direction and at a level of a passline, the cooling device comprises:

a cooling bed having a plurality of spray bars extending transversely with respect to the transportation direction, wherein each spray bar, when viewed transversely to the transportation direction, has only two outer sections and a central section arranged between the two outer sections, and the sections are arranged transverse to the transportation direction;

a respective dedicated, individually controllable valve device for each of the central and the outer sections and each valve device is configured for injecting a liquid cooling medium into a respective one of the sections;

the flat rolled product may be impinged upon with a central flow rate profile (V1) and outer flow rate profiles (V2, V3) of the liquid cooling medium; and when the valve devices are fully opened, first outlet orifices arranged in the central section of each spray bar produce the central flow rate profile (V1), which, when viewed transversely to the transportation direction, is at a maximum in a center of the central section and decreases toward edges of the central section, such that the central flow rate profile (V1) defines a central triangle in which one side of the triangle runs transversely to the transportation direction (x) and two other sides of the triangle are edges of equal length;

second outlet orifices arranged in the outer sections produce the outer flow rate profile (V2, V3) of the liquid cooling medium, which, when viewed transversely to the transportation direction (x), are at a maximum at respective edges of the outer sections and decrease toward the central section, such that each outer flow rate profile (V2, V3) defines an outer triangle in which one side runs parallel to and one side runs transversely to the transportation direction (x), and wherein the central triangle and the two outer triangles combine to form a rectangle.

2. The cooling device as claimed in claim 1, further comprising;

the valve devices are switchable in a binary manner between open and closed; and a respective pump configured and operable for selectively adjusting a volume of liquid cooling medium injected into each of the sections to set an operating pressure generated by the respective pump operable for each section and/or to set a delivery volume provided by the respective pump.

3. The cooling device as claimed in claim 1, further comprising:

at least two of the spray bars, comprised of at least one spray bar above and at least one other spray bar below the passline.

4. The cooling device as claimed in claim 1, further comprising:

a holding frame, on which at least one of the spray bars is arranged, has a position fixed with respect to the passline; and an adjusting device connected with the at least one spray bar for setting a distance of the at least one said spray bar from the passline.

5. The cooling device as claimed in claim 4, further comprising:

an adjustment range of at least 20 cm ($\delta a$) by which the distance of the at least one spray bar from the passline is variable.

6. The cooling device as claimed in claim 1, further comprising:

a holding frame, on which at least one of the spray bars is arranged, has a position fixed with respect to the passline; and an adjusting device configured for operating the at least one spray bar to be pivoted through a pivoting angle about an axis of rotation.

7. The cooling device as claimed in claim 1, further comprising:

an intermediate frame on which at least one of the spray bars is arranged;

a holding frame on which the intermediate frame is arranged, and the holding frame is in a position fixed with respect to the passline; and a respective adjusting device connected to the spray bar and to the intermediate frame, the adjusting device being configured to set an adjustable distance of the spray bar from the intermediate frame, and the intermediate frame is pivotable, through a pivoting angle about an axis of rotation, by the adjusting device assigned to the intermediate frame.

8. The cooling device as claimed in claim 1, further comprising:

an intermediate frame on which at least one of the spray bars is arranged;

a holding frame on which the intermediate frame is arranged; the holding frame is in a position fixed with respect to the passline; and a respective adjusting device connected to the at least one spray bar and to the intermediate frame, for pivoting the at least one spray bar through a pivoting angle about an axis of rotation by means of the adjusting device for the at least one spray bar, and the adjusting device assigned to the intermediate frame to be at a settable distance of the intermediate frame from the holding frame.

9. The cooling device as claimed in claim 6, further comprising:

when viewed transversely to the transportation direction, the axis of rotation is arranged at an edge of the spray bar and runs parallel to the transportation direction (x).

10. The cooling device as claimed in claim 6 wherein the pivoting angle is at least 20°.

11. The cooling device as claimed in claim 1, further comprising:

an intermediate frame on which at least one of the spray bars is arranged;

a holding frame on which the intermediate frame is arranged, and the holding frame is in a position fixed with respect to the passline;

a first adjusting device configured for adjusting the distance of the intermediate frame from the holding frame; and a second adjusting device connected to the spray bar and the spray bar is pivotable, through a pivoting angle about an axis of rotation, by the second adjusting device assigned to the intermediate frame.

12. The cooling device as claimed in claim 2, wherein the respective operating pressures generated by the respective pumps are each at least 0.5 bar.

13. The cooling device as claimed in claim 2, wherein the respective operating pressures generated by the respective pumps are each in the range of 1.5 bar to 3.0 bar.

14. A rolling train for rolling flat rolled product, comprising:

the rolling train has at least one roughing stand and a plurality of finishing stands located downstream in a transporting direction of the flat rolled product from the roughing stand, a cooling device as claimed in claim 1, positioned upstream of the roughing stand or positioned downstream between the roughing stand and the finishing stand located immediately downstream thereof.

* * * * *